United States Patent [19]

Bampfield

[11] 4,420,349

[45] Dec. 13, 1983

[54] EMULSION EXPLOSIVE COMPOSITIONS AND METHOD OF PREPARATION

[75] Inventor: Howard A. Bampfield, Otterburn Park, Canada

[73] Assignee: C-I-L Inc., North York, Ontario, Canada

[21] Appl. No.: 456,843

[22] Filed: Jan. 10, 1983

[30] Foreign Application Priority Data

Feb. 2, 1982 [CA] Canada ..... 395372

[51] Int. Cl.[3] ..... C06B 45/00

[52] U.S. Cl. ..... 149/2; 149/21; 149/105; 149/46; 149/61; 149/83; 149/85

[58] Field of Search ..... 149/2, 60, 61, 46, 83, 149/88, 105, 107

[56] References Cited

U.S. PATENT DOCUMENTS

| | | | |
|---|---|---|---|
| 4,104,092 | 8/1978 | Mullay | 149/44 |
| 4,287,010 | 9/1981 | Owen | 149/2 |
| 4,310,364 | 1/1982 | Ekman et al. | 149/2 |
| 4,315,784 | 2/1982 | Hattori et al. | 149/2 |
| 4,315,787 | 2/1982 | Hattori et al. | 149/2 |
| 4,322,258 | 3/1982 | Sudweeks et al. | 149/2 |
| 4,326,900 | 4/1982 | Hattori et al. | 149/2 |
| 4,356,044 | 10/1982 | Jessop et al. | 149/2 |
| 4,357,184 | 11/1982 | Binet et al. | 149/2 |
| 4,371,408 | 2/1983 | Fillman | 149/2 |

*Primary Examiner*—Stephen J. Lechert, Jr.
*Assistant Examiner*—Howard J. Locker
*Attorney, Agent, or Firm*—Donald G. Ballantyne

[57] ABSTRACT

A two-component emulsion explosive composition is provided consisting of a continuous oil/fuel phase and a discontinuous aqueous oxidizer salt phase and, as an emulsifier, a dimer acid glyceride wherein the dimer acid has a carbon atom chain length of C18-C60. The composition demonstrates superior properties of long period storage stability and sensitivity.

8 Claims, No Drawings

EMULSION EXPLOSIVE COMPOSITIONS AND METHOD OF PREPARATION

The present invention relates to water-in-oil emulsion explosive compositions which consist of a continuous oil/fuel phase which is external and a discontinuous aqueous oxidizing salt solution phase which is internal. In particular, the invention relates to such emulsion explosive compositions containing a unique emulsifying agent.

Water-in-oil emulsion explosives are now well known in the explosives art and have been demonstrated to be safe, economic and simple to manufacture and to yield excellent blasting results. Bluhm, in U.S. Pat. No. 3,447,978, disclosed an emulsion explosives composition comprising an aqueous discontinuous phase containing dissolved oxygen-supplying salts, a carbonaceous fuel continuous phase, an occluded gas and an emulsifier. Since Bluhm, further disclosures have described improvements and variations in water-in-oil explosives compositions. These include U.S. Pat. Nos. 3,674,578, Cattermole et al., 3,770,522, Tomic, 3,715,247, Wade, 3,765,964, Wade, 4,110,134, Wade, 4,149,916, Wade, 4,141,917, Wade, 4,141,767, Sudweeks & Jessup, Canadian Pat. No. 1,096,173, Binet and Seto, U.S. Pat. Nos. 4,111,727, Clay, 4,104,092, Mullay, 4,231,821, Sudweeks & Lawrence, 4,218,272, Brockington, 4,138,281, Olney & Wade, 4,216,040, Sudweeks & Jessup.

All of the aforementioned emulsion type explosive compositions contain an essential emulsifier ingredient. Without the presence of such an emulsifier, the mixed phases of the compositions soon separate to form a layered mixture having no utility as an explosive. Typical of monomeric emulsifiers used in the prior art compositions may be mentioned saturated fatty acids and fatty acid salts, glycerol stearates, esters of polyethylene oxide, fatty amines and esters, polyvinyl alcohol, sorbitan esters, phosphate esters, polyethylene glycol esters, alkyl-aromatic sulphonic acids, amides, triethanolamine oleate, amine acetate, imidazolines, unsaturated fatty chain oxazolines, and mercaptans. Among the polymeric emulsifiers employed have been alkyds, ethylene oxide/propylene oxide copolymers and hydrophobe/-hydrophil block copylymers. In some cases mixtures or blends of emulsifiers are used. The emulsifier chosen will be the one which functions most expeditiously in the environment of the emulsion explosive being formulated. In many instances, the use of known or common emulsifiers fails to provide a water-in-oil emulsion of required stability on the shelf and for field use. Such common emulsifiers frequently lead to explosives compositions having a viscosity too low to be conveniently packaged in, for example, paper cartridges. For optimum, reliable sensitivity and performances, dispersion of the discontinuous salt-containing aqueous phase in the continuous oil/fuel phase at a micron level droplet size must be achieved and retained, especially when the emulsion is extruded during packaging operations and when the packaged composition is stored at elevated temperatures. It has been the continuing objective of the industry to seek those manufacturing processes and emulsifiers which will achieve the desired aims.

Briefly described, and in the context of a water-in-oil emulsion explosive, an emulsifier is a substance which, in the presence of the two immiscible liquid phases, prevents the droplets of the dispersed aqueous phase from coalescing and separating from the oil/fuel phase.

This is achieved by reducing the surface tension or protecting the aqueous droplets with a surrounding film. In a water-in-oil emulsion explosive, the emulsifiers of choice will normally be a hydrocarbon chain having a polar group such as the soaps and long chain sugar esters and amines. Examples of these are sorbitan oleates, sodium stearate, and octadecylamine. When added to a water-in-oil emulsion explosive, the hydrocarbon chain attaches itself to the oil/fuel component while the polar group is attracted to the aqueous phase. For maximum stability in a water-in-oil emulsion explosive system, the emulsifier chosen will have a greater attraction for the oil than for the water, thereby protecting or isolating the aqueous droplets and preventing coalescence. Water-in-oil emulsion explosives can become "broken" or demulsified, for example, by physical means such as freezing or heating, by vibration or manipulation during packaging or by chemical destruction of the emulsifier in the harsh chemical environment of the explosive mixture.

Particularly useful and popular amongst the emulsifiers employed in prior art explosives compositions are reaction products of glycerol which are prepared by reacting glycerol with a monobasic acid in the presence of a catalyst. Glycerol stearate is typical of such emulsifiers. It has now been found that an emulsifier which is the reaction product of glycerol and a dimer acid provides an emulsion explosive composition of enhanced properties. By dimer acid is meant a polymerized unsaturated fatty acid prepared from $C_{18}$ or greater length fatty acid by, for example, the clay-catalyzed or thermal condensation the $C_{18}$ or greater length fatty acid followed by separation of the polycarboxylic fraction. (See Kirk-Othmer, Encyclopedia of Chemical Technology, Third Edition, Vol. 7, pp. 768–782). A commercially available dimer acid is, for example, EMPOL (Reg. TM) sold by Emery Industries Limited of Cincinnati, Ohio. Generally, such dimer acids comprise 86% dimer fraction and 13% trimer fraction with a trace of monomer fraction. It has been noted that the emulsifier prepared from these commercial product dimer acids tends to result in a more stable explosive emulsion than an emulsifier made from a pure or refined dimer acid. Therefore, it is not required, for purposes of the present invention, to employ any refined dimer acids in the preparation of the emulsifier.

The dimer acid glyceride emulsifier useful in the emulsion explosive composition of the invention may be prepared by heating together a mixture of dimer acid and glycerol at a temperature of 180° C. for 30 minutes in the presence of a catalyst, for example, tetrabutyltitanate. Reaction times less than or greater than 30 minutes at a temperature of 180° C. tend to result in an emulsifier of less than optimum utility because at shorter times the reaction is incomplete, while at longer times polymerization takes place resulting in a product which is insoluble in the oil/fuel phase. The preferred ratio of acid-to-glycerol is 1 equivalent weight of dimer acid to from 0.4 to 1 mole of glycerol. The amount of catalyst is conveniently 0.5% by weight of the total composition. The resulting dimer acid glyceride emulsifier is a dark coloured viscous liquid which may be easily incorporated in the oil/fuel phase of a water-in-oil emulsion explosive. The resulting explosive composition product is relatively soft and dough-like in consistency which quality is obtained without the use of any rheology-modifying components such as, for example, waxes and thickeners. The amount of emulsifier used is from 0.5 to 4% by weight and preferably from 0.5 to 1.0% by weight of the total composition, the chosen amount being selected on the basis of the ratio of oil phase to aqueous phase.

The carbonaceous liquid or liquifiable fuel components of the emulsion explosive composition which comprises the oil phase of the present invention include, for example, parafinic, olefinic, aromatic and naphthenic hydrocarbons, petroleum waxes, microcrystalline wax, paraffin wax, mineral and animal wax, petroleum, mineral and vegetable oils, dinitrotoluene, nitroxylenes, and mixtures of these. The aqueous component or phase of the emulsified explosive will have a dissolved inorganic oxygen-supplying salt therein. Such an oxidizer salt will generally be ammonium nitrate but a portion of the ammonium nitrate can be replaced by one or more other inorganic salts such as, for example, the alkali or alkaline earth metal nitrates or perchlorates. Additionally, the emulsion explosive of the invention may contain optional additional fuel, sensitizer or filler ingredients, such as, for example, glass or resin microspheres, particulate light metal, void-containing material such as styrofoam beads or vermiculate, particulate carbonaceous material, for example, gilsonite or coal, vegetable matter such as round nut hulls or grain-hulls, sulfur and the like. Air or gas bubbles, for sensitization purposes, may be injected or mixed into the emulsion composition or may be generated in situ from a gas generating material such as a peroxide or sodium nitrate.

The following examples and tables, which are not intended as a limitation on the scope of the invention, are provided to provide further illustration of the invention.

EXAMPLE 1

An emulsifier comprising 1 mole of glycerol to one equivalent of dimer acid, was prepared as follows: 281.5 parts by weight of a dimer acid (EMPOL 1018 - Reg. TM), 92.1 parts by weight of anhydrous glycerol and 1.8 parts by weight of tetrabutyl titanate catalyst were heated together by stirring in an open vessel at 180° C. for 30 minutes. The resulting dark colored liquid product, upon cooling, is used without further purification in the emulsion explosive composition of the invention.

EXAMPLES 2–10

The procedure described in Example 1 was repeated employing a number of different ratios of acid/glycerol. In addition, various fatty acids which were not dimer acids were employed for comparison purposes. All parts were parts by weight. One part of each emulsifier produced was dissolved in 5 parts of mineral oil and to this was slowly added, with stirring, a hot solution of ammonium nitrate (68 parts) and sodium nitrate (20 parts) in water (12 parts). The resultant water-in-oil emulsions were tested for stability over extended periods of storage. The results are tabulated in Table I, below.

TABLE 1

| Example No. | Acid | Acid/ Glycerol Ratio[1] | Emulsion Stability |
|---|---|---|---|
| 2 | $C_{36}$ diacid[2] | 1:1 | <100 days[3] |
| 3 | $C_{36}$ diacid | 1:0.8 | >100 days |
| 4 | $C_{36}$ diacid | 1:0.6 | >100 days |
| 5 | $C_{36}$ diacid | 1:0.5 | <100 days |
| 6 | $C_{18}$–$C_{36}$ monoacid[4] | 1:5 or 1:0.8 | no emulsion |
| 7 | $C_{54}$ triacid | 1:5 | 8 hours |

TABLE 1-continued

| Example No. | Acid | Acid/ Glycerol Ratio[1] | Emulsion Stability |
|---|---|---|---|
| 8 | $C_{54}$ triacid | 1:0.8 | no emulsion |
| 9 | 9-carboxy stearic acid | 1:1 | no emulsion |
| 10 | Suberic acid | 1:1 and 1:5 | no emulsion |

[1]Equivalents of acid/moles glycerol
[2]Proprietary product marketed by Emery Industries Limited EMPOL (Reg. TM)
[3]At ambient temperature
[4]Proprietary product marketed by Croda Industries Limited As can be seen from Table I, the emulsions containing the emulsifier made with $C_{36}$ diacid demonstrated superior storage stability.

EXAMPLES 11–16

A series of emulsifiers prepared by the method of Example 1 were formulated into emulsions similar to that described in Example 2. To these were added a proportion of glass microspheres to render them detonable on initiation by a blasting cap. For comparison, similar compositions were formulated using conventional or prior art emulsifiers. All compositions were exposed to temperature cycling between −17° C. and +35° C. to accelerate the aging which occurs in long term storage. Sample 25 mm diameter cartridges were subjected to minimum primer detonation testing after various cycle intervals. The maintenance of sensitivity to initiation during storage is deemed a measure of the stability of the emulsion explosive. The results are tabulated in Table II, below.

TABLE II

| Example No. | Emulsifier | Ctg. Density | Minimum n = 0 | 2 | Primer 4 | After n Cycles 5 | 6 | Rheology |
|---|---|---|---|---|---|---|---|---|
| 11 | A[1] | 1.14 | R-7[3] | R-7 | | R-7 | | Very heavy grease |
| 12 | B[1] | 1.12 | R-9 | | R-9 | | R-11 | Putty like |
| 13 | C[1] | 1.18 | R-10 | | EB[2] | | | Putty like |
| 14 | D[1] | 1.15 | R-7 | | | R-7 | | Pourable |
| 15 | E[1] | 1.15 | | R-10 | | | R-15 | Thin grease |
| 16 | F[1] | 1.15 | | EB[2] | | | | |

[1]D is heptadecenyl (bishydroxymethylene) oxazoline
E is a polymeric emulsifier
A is dimer acid glyceride: 1 equivalent of dimer acid to 0.8 mole glycerol
B is dimer acid glyceride: 1 equivalent of dimer acid to 0.6 mole glycerol
C is dimer acid glyceride: 2 equivalents of dimer acid to 1 mole glycerol
F is a mixture of glycerol mono-oleate and glycerol dioleates sold as Atmos 300 (Reg. TM)
[2]High strength blasting cap containing 0.78 g PETN as base charge.
[3]Caps designated R-n contain 0.1 g initiating composition and $(n - 3) \times 0.05$ g PETN $13 \geqq n \geqq 4$ or $(n - 13) \times 0.1 + 0.5$ g PETN $16 \geqq n \geqq 14$ base charge.

From Table II it can be seen that the compositions containing the dimer acid glyceride emulsifiers, particularly Examples 11 and 12, retained a high level of sensitivity and an ideal, putty-like consistency.

EXAMPLE 17

Seven parts of an emulsifier made by the procedure of Example 1 (from 1 equivalent of dimer acid and 0.8 mole glycerine), 7 parts of lecithin, 25 parts of paraffin oil and 17 parts of wax were heated to 80° C. and 94.4 parts of a solution of ammonium and sodium nitrates in water (68 parts ammonium nitrate, 20 parts sodium nitrate and 12 parts water) were added at 80° C. with mechanical agitation. The density of the resultant emulsion was reduced to 1.15 by the addition of glass microballoons. This product had the consistency of a soft dough and was still sensitive to a high strength blasting cap after 5 cycles - 17/+35° C. at 5° C. in 25 mm diameter cartridges. This demonstrates that the glyceride surfactants of the present invention can be blended with less costly surfactants and still confer stability and viscosity on the resultant emulsion.

EXAMPLE 18

Seven parts of glyceride emulsifier as described in Example 17, 7 parts of octadecenyl (bishydroxymethylene) oxazoline and 4.0 parts of paraffin oil were heated to 80° C. and 94.6 parts of a solution of oxidizer salts made as Example 17 were added with mechanical agitation at 80° C. The resultant emulsion was detonable with an R-6 blasting cap after having its density reduced by the addition of glass microballoons. After 5 cycles −17/+35° C. the product detonated when initiated with an R-9 blasting cap in 25 mm diameter cartridges at 5° C. This explosive product had the handling characteristics of a heavy grease and was easily retained in a paper cartridge. A similar emulsion made with 14 parts of octadecenyl (bishydroxymethylene) oxazoline was too fluid to be retained in a paper cartridge.

EXAMPLE 19

One part of a glyceride emulsifier made as described in Example 17 was dissolved in 19 parts of dinitrotoluene (commercial mixture of isomers sold by Bayer) at 80° C. To this was added 80 parts of the hot oxidizer solution of Example 17 with mechanical agitation. The density of the resultant emulsion was reduced with glass microspheres to 1.34. The resultant explosive was detonable in 25 mm diameter cartridges with an R-15 blasting cap.

EXAMPLE 20

One part of a glyceride emulsifier made as described in Example 17 was dissolved in 6 parts of No. 2 fuel oil and 93 parts of an oxidizer solution of composition, 63 parts ammonium nitrate, 19 parts sodium nitrate, 11 parts water added at 80° C. with mechanical agitation. The density of the resulting emulsion was reduced to 1.15 with microballoons. The product detonated in 25 mm diameter cartridges when initiated with an R-9 cap.

I claim:

1. A thermally and storage stable water-in-oilemulsion explosive of putty-like consistency comprising a water-immiscible liquid organic fuel continuous phase, an aqueous inorganic oxidizer salt solution discontinuous phase and from 0.5 to 4% by weight of the total composition of a dimer acid glyceride as emulsifier wherein the dimer acid has a carbon atom chain length of $C_{18}$–$C_{60}$.

2. A composition as claimed in claim 1 wherein the dimer acid glyceride emulsifier comprises from 0.5 to 1% by weight of the total composition.

3. A composition as claim in claim 1 also containing sufficient gas bubbles or void-containing material to render it detonable by blasting cap initiation.

4. A composition as claimed in claim 1 wherein the said dimer acid glyceride emulsifier comprises the reaction product of one equivalent weight of dimer acid to from 0.4 to 1 mole of glycerol.

5. A composition as claimed in claim 4 wherein the dimer acid and glycerol are heated together at 180° C. for 30 minutes in the presence of a catalyst.

6. A composition as claimed in claim 1 wherein the liquid organic fuel is selected from the group consisting of parafinic, olefinic, aromatic and naphthenic hydrocarbons, petroleum waxes, microcrystalline wax, paraffin wax, mineral and animal wax, petroleum, mineral and vegetable oils, dinitrotoluene, nitroxylenes, and mixtures of these.

7. A composition as claimed in claim 1 wherein the aqueous inorganic salt is selected from ammonium nitrate, alkali or alkaline earth metal nitrates and perchlorates and mixtures thereof.

8. A composition as claimed in claim 1 wherein up to 50% by volume of the said dimer acid glyceride emulsifier is replaced by a conventional emulsifier.

* * * * *